US006112778A

United States Patent [19]

Nish et al.

[11] Patent Number: 6,112,778

[45] Date of Patent: Sep. 5, 2000

[54] FILL VALVES, NOZZLE ADAPTERS FOR FILL VALVES, AND METHODS

[75] Inventors: Terry E. Nish; Cecil Ray McCray, both of Salt Lake City, Utah

[73] Assignee: Servi-Tech, Inc, Salt Lake City, Utah

[21] Appl. No.: 09/246,008

[22] Filed: Jan. 20, 1999

Related U.S. Application Data

[63] Continuation-in-part of application No. 08/419,625, Apr. 10, 1995, Pat. No. 5,582,217, and a division of application No. 08/739,667, Oct. 31, 1996, Pat. No. 5,954,100.

[51] Int. Cl.[7] ..... B65B 31/00

[52] U.S. Cl. ..... 141/6; 4/47; 4/285; 4/311 R

[58] Field of Search ..... 141/4, 6, 39–42, 141/46–49, 51, 59, 60, 290–294, 285, 301–303, 311 R

[56] References Cited

U.S. PATENT DOCUMENTS

| | | | |
|---|---|---|---|
| 2,783,785 | 3/1957 | Day et al. | 141/57 |
| 3,908,717 | 9/1975 | Rademacher et al. | 141/46 |
| 4,387,748 | 6/1983 | White | 141/57 |
| 4,750,533 | 6/1988 | Yun | 141/46 |
| 5,054,527 | 10/1991 | Rozier | 141/39 |
| 5,119,853 | 6/1992 | Petri et al. | 141/39 |
| 5,141,035 | 8/1992 | Nish et al. | 414/1 |
| 5,413,153 | 5/1995 | Zwilling et al. | 141/39 |

*Primary Examiner*—Steven O. Douglas
*Assistant Examiner*—Timothy L. Maust
*Attorney, Agent, or Firm*—Foster & Foster

[57] ABSTRACT

Beverage fill valves, adapter nozzles for placement at the discharge end of beverage fill valves, novel counterpressure, and snift discharge valves including plungers, actuators or buttons, and unique counterpressure snift flow paths in novel combination with fill valves and/or fill valves with adapter nozzles, and related methods are disclosed, whereby automatic filling of a can having a smaller diametral opening at the top thereof is accommodated.

6 Claims, 9 Drawing Sheets

FILL VALVES, NOZZLE ADAPTERS FOR FILL VALVES, AND METHODS

This application is a continuation-in-part of U.S. patent application Ser. No. 08/419,625, filed Apr. 10, 1995, now U.S. Pat. No. 5,582,217 and a division of U.S. patent application Ser. No. 08/739,667, filed Oct. 31, 1996, now U.S. Pat. No. 5,954,100.

FIELD OF INVENTION

The present invention relates generally to machinery by which a predetermined quantity of beverage is placed in a can after which the can is capped, and, more particularly, to novel beverage fill valves, adapter nozzles for placement at the discharge end of beverage fill valves, and novel counterpressure snift valves comprising plungers, actuators, or buttons and unique counterpressure and snift flow paths in novel combination with fill valves and/or fill valves with adapter nozzles, novel gaskets, and related methods, whereby automatic filling of a can having a smaller diametral opening at the top thereof is accommodated.

BACKGROUND AND RELATED ART

Typically a beverage, such as soda pop and beer, is dispensed by automated machinery into individual cans each comprising an open top, which is later capped. See the disclosures of U.S. Pat. Nos. 4,387,748 and 4,750,533.

Such automated machinery comprises fill valves by which pressurized gas and beverage are delivered into each can through the open top thereof. Prior art fill valves comprise an array of beverage influent flow paths and a standard distal beverage effluent nozzle comprising an array of downwardly and outwardly directed beverage passages, often ending in exposed discharge tubes. In the past, with 204 sized cans and larger, this standard effluent nozzle was diametrally sized to fit through the opening in the top of a can of predetermined size on a close tolerance basis so that the discharge streams of beverage are emitted from relatively low locations within the interior of the can and strike against the inside surface of the side wall of the can. The flow distance between the end of each discharged stream and the side wall of the can is minimal so that beverage foaming is kept within tolerable limits.

Particularly in respect to cans made of aluminum, the beverage industry has continually sought ways to reduce the amount of aluminum used to fabricate each can. The thickness of the side wall has been materially reduced. Also, from time to time the beverage industry has reduced the size of the lid placed upon the aluminum can in its quest to further reduce the amount of aluminum used. Reduction in lid size correspondingly reduces the pre-lid top opening in the can.

In recent times, this trend has reduced the can top opening size first from a 206 size to a 204 size and more recently to a 202 size. A further reduction to a size 114 is anticipated. The size designations mentioned above (206, 204, 202, and 114) are codes which identify the diameters of the lids, i.e. 2 5/16", 2 4/16", 2 2/16", and 1 14/16", respectively. With such reductions in aluminum lid sizes and corresponding reduction in the size of openings at the top of aluminum cans comes obsolescence of certain parts of the beverage-filling machinery. For example, a size #204 can will not accept the distal discharge nozzle structure of the pre-existing standard fill valves when lowered due to dimension interference. Thus, the progressive trend by the beverage industry to smaller and smaller lids and, therefore, smaller and smaller openings at the top of aluminum cans leaves existing fill valves nonaccommodating. The normal solution in the past to this problem has been to replace the entire old dimensionally-nonaccommodating fill valves with smaller fill valves of the same design which fit, on a close tolerance basis, through the smaller top opening of the cans. However, this replacement approach, on both a plant and an industry-wide basis, is very costly especially when considering that heretofore each new lid size typically has required total replacement of all existing fill valves in each plant. To reduce the costs associated with such plant conversions, the nozzle adapters forming the subject matter of U.S. Pat. No. 5,141,035 were created.

Furthermore, other problems are created by use of cans having progressively smaller openings in conjunction with existing fill valves of standard design or modified at the discharge nozzle, which are not addressed by merely miniaturizing or modifying existing fill valve configurations.

Attempted fill valve conversions to include a modified nozzle portion is accompanied by a need to discard many of the older fill valves during the attempted conversion due to excessive corrosion, pitting, worn out counterpressure tubes, troublesome snift tubes, nut and plunger assemblies, and other damage accumulated over years of use. These disadvantages together with the costs of labor, machine work, and materials required to salvage older fill valves and to convert them for use with cans having smaller openings have provided a strong motivation to invent new fill valves, which effectively, efficiently, and cost-effectively accommodate filling of cans comprising smaller openings.

A further impediment to efficient transformation to cans comprising smaller openings has been the old snift systems. It has long been the practice of the industry that the snift release must come from the back side of the valve and can, so as not to pull product out of the can during the snift cycle. Otherwise, it was believed that a wet snift would occur resulting in product loss through the snift release and an unstable product in the can. More specifically, it was believed that the centrifugal force of the filler rotation puts the product in the can on a high angle at the front of the can. Therefore, by locating the snift release at the rear portion of the can and valve, product loss due to a wet snift would be reduced. Accordingly, the complicated machinery and involved methods of rear snifting the $CO_2$ gas from the can were used. However, with the advent of cans comprised of very small openings, rear snifting sometimes slows the rate at which canned products can be produced with automatic beverage filling machinery and puts into place a higher incidence of product instability.

Many if not most or all fill valve designs feed product in parallel through a plurality of side-by-side tubes into one can. Typically, the number of influent flow paths equals the number of effluent flow paths. Heretofore, the distal ends of fill valve tubes extend downwardly beyond the remainder of the fill valve to a location a substantial distance into the can so as to become submerged in the product within the can in order to precisely facilitate fill valve shut off. This technique creates a discharge region for the product entering the can from one-third to one-half way down the interior of the can wall when cans with larger openings are used, but invariably causes a wild foaming condition resulting in short fills when cans with smaller openings are used. This may also leave air trapped in the finished product.

Whenever a foaming problem is encountered, no matter what the reason, an undesirable reduction in the rate of production is inevitably a consequence and, sometimes, the product must be expensively refrigerated prior to canning.

Certain prior fill valve configurations prevent advantageous revision to the sealing gasket and the manner in which counterpressure $CO_2$ is delivered to and prevented from leaking across the sealing gasket to the atmosphere when used to fill cans comprising smaller openings, which causes short fill cans, foaming, and can flood the product bowl if the filler is shut down with cans on the machine.

Facile setting of a desirable fill height has also been a problem of trying to adapt older beverage filling equipment to cans having smaller openings.

Further, adaptation in the industry over time to each can successively having a smaller opening has been piecemeal, i.e. a series of changes to filling equipment applicable only to cans comprising the next smaller opening, which changes do not work well for later cans comprising even a smaller opening. Permanent machinery solutions for cans of successively smaller openings have not been forthcoming within the industry.

A further problem is presented by automated filling of cans having a smaller opening. Specifically, with the delivery of product from the fill valve at a higher location, the amount of $CO_2$ gas required in the head space and the snift chamber of the fill valve has increased. This increase in the required $CO_2$ undesirably slows the rate of production using existing automatic filling machinery.

A related problem involves the requirement that can filling occur through an array of tubes of the fill valve, which distally extend into and are submerged within the product placed in the can to accommodate ball cage shut off of the fill valve. Continued use of such an array of product discharged tubes (sometimes with staggered lengths to compensate for an angle created in the product in the can due to centrifugal force) has increased the rate at which cans with smaller openings are damaged when the can is placed on the fill valve. Also, these tubes undesirably carry away product from the can when removed, resulting in loss of product.

Also, in certain prior installations, a screen for each circular beverage passageway has been used creating certain problems. These individual screens cause both production and maintenance problems. These individual screens typically are from 30–34 mesh and these screens and their related cubes are very bothersome from a maintenance standpoint. During the canning of beer, these screens get a build up on them referred to in the industry as beer stone. Beer stone in time will plug the screen and cause foaming and/or short fills.

Prior can sealing gaskets also do not work well with cans having smaller openings, because of a high incidence of interference and can damage problems.

BRIEF SUMMARY AND OBJECT OF THE INVENTION

In brief summary, the present invention overcomes or substantially alleviates problems associated with automatic beverage filling equipment particularly in respect to long term solutions in respect to adaptation of such equipment to efficiently and cost-effectively fill cans having smaller and smaller openings. Novel fill valves, nozzles, counterpressure and snift valve mechanisms, counterpressure snift discharge flow paths, and other improvements for fill valves are provided by the present invention, as are related methods.

With the foregoing in mind it is a primary object of the invention to overcome or substantially alleviate problems associated with automatic beverage filling equipment.

Another valuable object is provision of long-term method and apparatus solutions in respect to the adaptation of beverage filling equipment to efficiently and cost-effectively fill cans having smaller and smaller openings.

Another paramount object is the provision of novel fill valves, nozzles, counterpressure and snift valve mechanisms, counterpressure and snift discharge flow paths, and other improvements for fill valves, and related methods.

A further object of significance is the provision of novel valve features and related methods which accommodate automatic filling of cans having smaller size openings in such a way that there is not: (a) a loss in production rate; (b) increased foaming; (c) increased short fills; (d) a higher rate of can damage; (e) flooding of the product bowl; (f) a need for greater amount of $CO_2$ in the cans comprising smaller openings; (g) a beer stone problem with screens; (h) a screen interface at each beverage passageway in fill valves; (i) an undesirable product entry angle for cans comprising smaller openings which preferably is directed toward the shoulder of the interior wall of the can; (j) a need to pre-refrigerate or cool the product; (k) an excessive total air content in canned beverages; (l) an enlarged consumption in the amount of and production time consumed by placement of counterpressure $CO_2$; (m) a perpetuation of the undesirable overtones caused by placement of the snift mechanism at the rear; (n) a perpetuation of an uninterrupted number of flow tubes and flow tubes the distal end of which extend beyond the remainder of the fill valve; (o) use of old style sealing gasket for fill valves which leak with cans comprising smaller openings; (p) the old style ball cage for setting fill height; and (q) the complicated and time-consuming snift mechanisms and snift flow paths of the past.

These and other objects and features of the present invention will be apparent from the detailed description taken with reference to the accompanying drawings.

Figure 16:
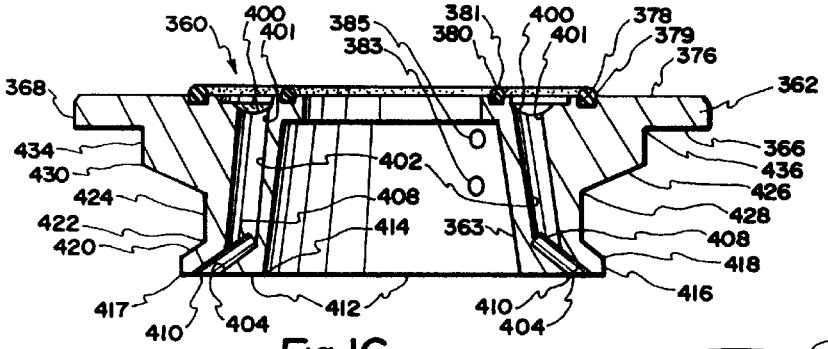
Figure 15A:
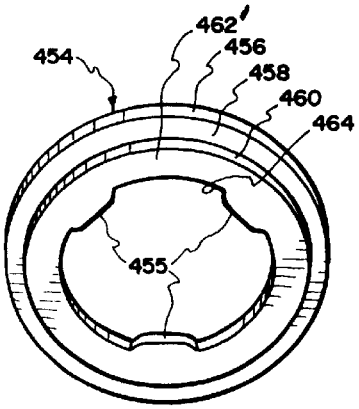
Figure 11:
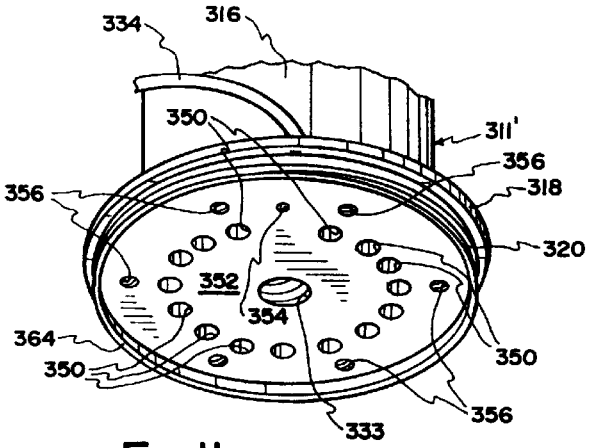
FIG. 11 is an enlarged fragmentary perspective view from a relatively low position of a portion of the fill valve of FIG.
Figure 12:
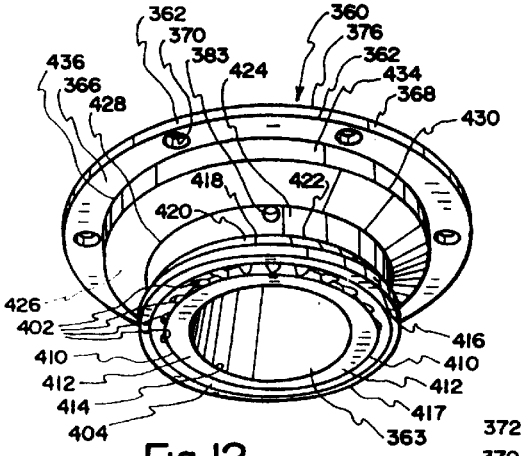
Figure 14:
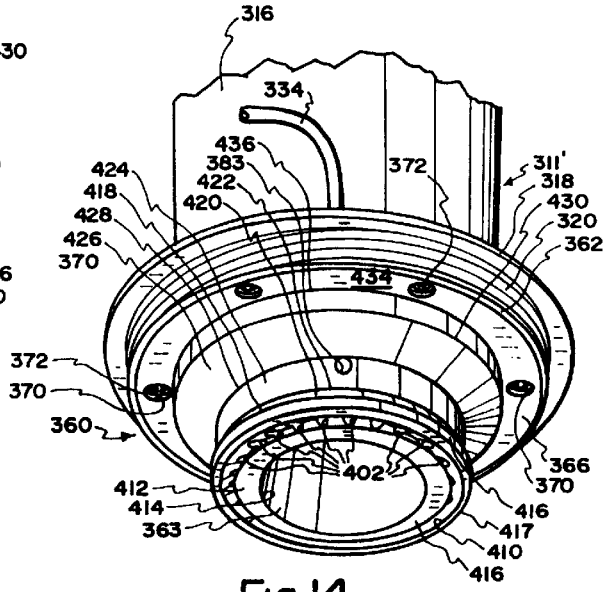
Figure 15:
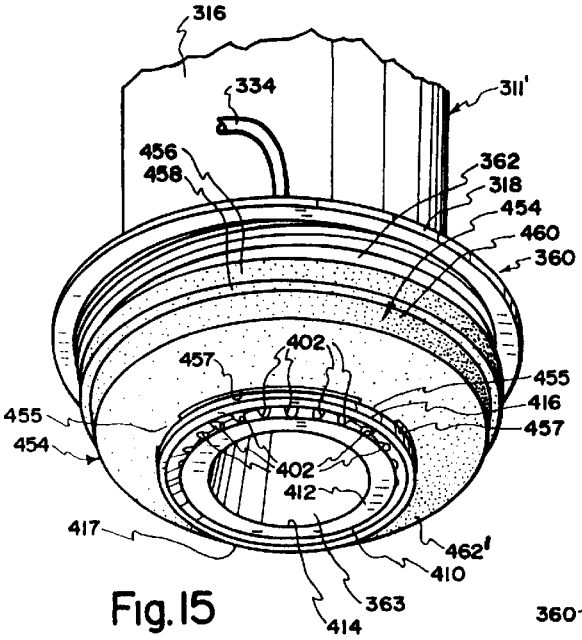
Figure 13:
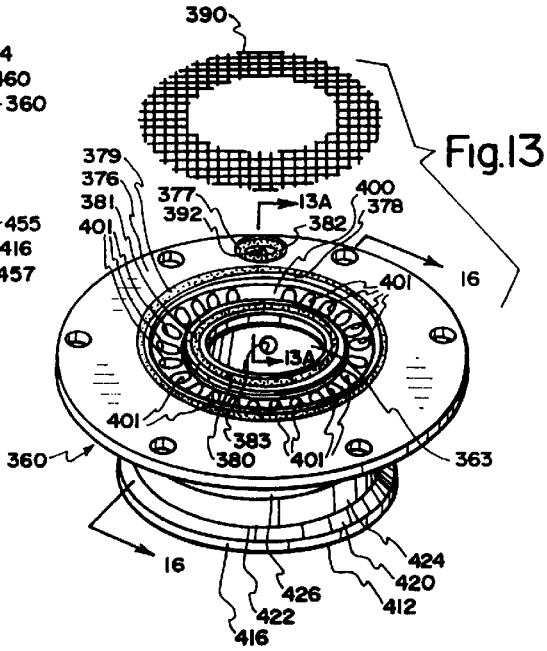
Figure 17:
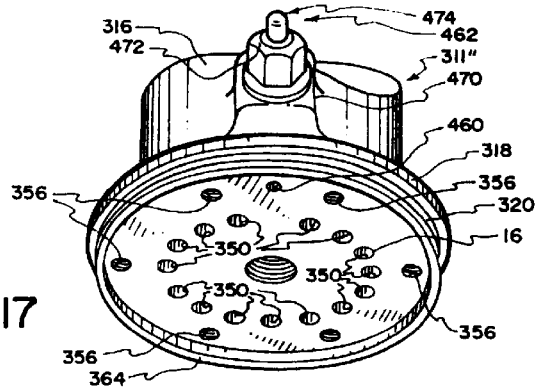
Figure 13A:
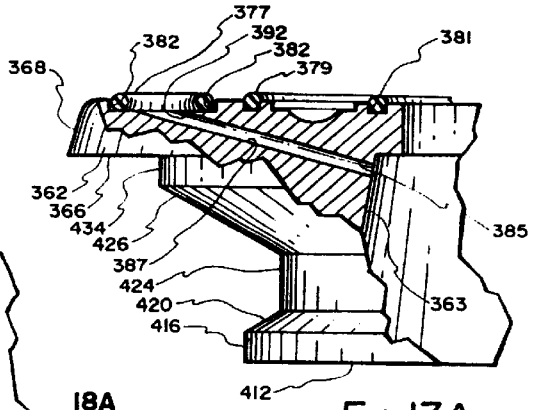
Figure 18:
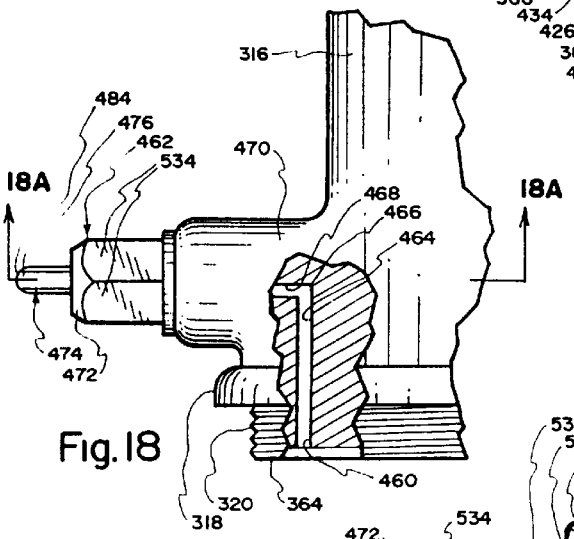
Figure 18A:
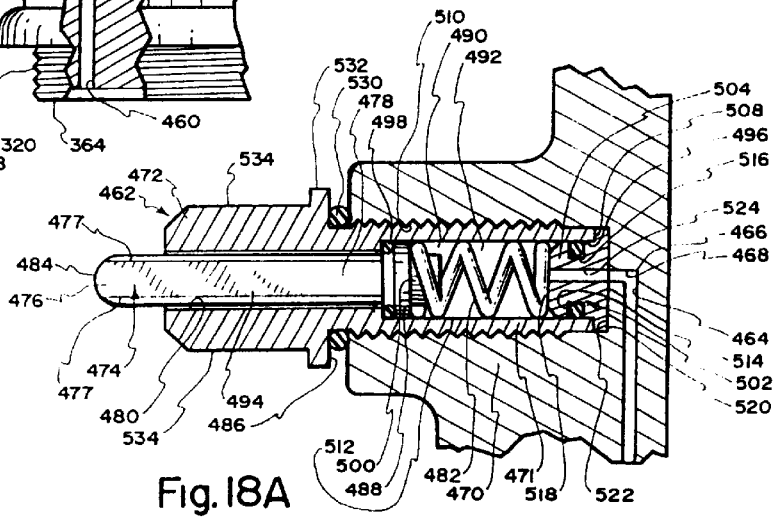

10, wherein the existing standard prior art distal discharged nozzle structure has been removed, preparatory to receiving an adaptor nozzle in accordance with the present invention;

FIG. 12 is an enlarged fragmentary perspective of an adopter nozzle of the present invention, viewed from a relatively low position, shown ready to be attached to the modified fill valve of FIG. 11;

FIG. 13 is an enlarged fragmentary exploded perspective, viewed from an elevated position, of the adapter nozzle of FIG. 12, shown ready to be attached to the modified fill valve of FIG. 11 and having a beverage screen adapted to be placed across the collective beverage flow path at the top of the adapter nozzle;

FIG. 13A is an enlarged fragmentary cross-section taken along lines 13A—13A of FIG. 13;

FIG. 14 is an enlarged fragmentary perspective view, from a relatively low position, illustrating the adapter nozzle of FIGS. 12 and 13 installed upon the modified fill valve of FIG. 11;

FIG. 15 is a fragmentary enlarged perspective view from a relatively low position, illustrating a seal, adapted to engage the top of a can, superimposed upon the adapter nozzle of FIG. 14;

FIG. 15A is a perspective of one can edge-engaging gasket possessing features of the present invention;

FIG. 16 is a cross-sectional view taken along lines 16—16 of FIG. 13;

FIG. 17 is an enlarged fragmentary perspective of a fill valve according to the present invention, illustrating a front snift button and an effluent snift port at the base of the fill valve above the nozzle;

FIG. 18 is a cross section through the fill valve of FIG. 17 showing the snift flow path between the effluent snift port and the front snift button; and FIG. 18A is an enlarged fragmentary cross-section taken along lines 18A—18A of FIG. 18.

DETAILED DESCRIPTION OF THE ILLUSTRATED EMBODIMENTS

The Snift Cam Mechanism

Reference is now made to the drawings wherein like numerals are used to designate like parts throughout. The apparatus illustrated in FIGS. 1–9 comprises a pre-fill snift cam assembly, generally designated 20. See FIGS. 1 and 2 in particular. The illustrated apparatus 20 also comprises a fluidic or pneumatic and electronic control system, generally designated 22, best illustrated in FIGS. 5 and 6.

The cam assembly 20 and the control 22 are adapted to be added to existing automatic beverage filling machinery with little or no renovation or modification of the filling equipment. The independent installation of the cam assembly 20 accommodates operation in conjunction with Meyer fillers and Crown fillers, for example.

As will be apparent, as this description proceeds, the cam assembly 20 and the control 22 are relatively simple in their construction and, given an absence of any need to modify the filling equipment, provide an economical, long-term solution to problems of the prior art which have long existed, particularly in respect to prohibiting the introduction of counterpressed air into beverage contained in the filler bowl.

The cam assembly 20 comprises a mounting block, generally designated 24, a cam, generally designated 26, a top bracket segment, generally designated 28, a bottom bracket segment, generally designated 30, and an air cylinder, generally designated 32 for reciprocating the cam 26 between enabled and disabled positions. Air under pressure is supplied through tube 34 from the control 22. See FIG. 3, in particular.

Mounting body 24 is preferably formed of solid stainless steel so as to comprise a generally rectangular, high profile, vertically-directed member, which comprises a top surface 36, a bottom surface 38, illustrated as being horizontal and parallel to surface 36, a back surface 40, which is generally vertical, and a front surface 42, which is generally parallel to surface 40. Mounting block 24 also comprises vertical and parallel spaced side surfaces 53. Surface 42 is interrupted by two, generally horizontally-directed grooves 44 and 46. Both grooves are U-shaped, groove 44 being substantially wider in a vertical direction than groove 46. Groove 44 accommodates mounting of the cam assembly 20 to a beam 48 for use in conjunction with a Meyer filler. See FIG. 8, which shows the cam assembly in simplified form with the bracket segments 28 and 30 removed. The fastening of mounting block 24 to the beam 48 may be accomplished using screws which pass through both apertures 50 in the mounting block 24 and aligned threaded apertures or threaded blind bores in the beam 48. The mounting is rigid.

Slot or groove 46, disposed in face or surface 42, is sized and shaped so as to receive one side edge of a generally rectangular horizontally disposed top plate 52 adjacent to which the cam 26 is reciprocated by air cylinder 32, in the manner explained below. Rectangular plate 52 is secured in groove 46 by welding or other suitable fastening technique and comprises an elongated slot 54 located in the center thereof. Arcuately-shaped grooves 56 are disposed in spaced parallel relationship at the underside of plate 52 to accommodate fixed orientation placement of two spaced cam biasing springs 58. A bottom plate 60 of greater area is disposed in parallel relationship with plate 52 but at a lower location. Part of plate 60 is contiguous at its upper surface with bottom surface 38 of mounting block 24 and is there secured or fastened by bonding, welding, or other suitable connection. The remainder of plate 60 cantilevers in a forward direction and is co-extensive in both horizontal directions with plate 52.

Plate 60 is illustrated as being solid, except for transverse slot 61. Plate 60 comprises a pair of spaced arcuate grooves 62 disposed in the top surface thereof which are respectively vertically aligned with grooves 56 to also accommodate retained placement of bias springs 58 by which the cam 26 is urged in a forward direction. The cam 26 is essentially parallel to but very slightly spaced from the bottom surface of plate 52 and the top surface of plate 60, allowing reciprocation of the cam 26 between the two plates 52 and 60.

The mounting block 24 comprises two spaced recesses 64 disposed and exposed at surface 42. The two circular blind recesses 64 are sized and located in alignment with the grooves 56 and 62 to receive, in seated relation, a proximal end of the associated bias spring 58. See FIG. 3. Thus, each spring is held against inadvertent displacement between recess 64 and spaced arcuate grooves 56 and 62.

Top bracket segment 28 comprises a single piece of bent stainless steel sheet comprising a top plate 66 having a cut-out or notched region 68 to accommodate passage of the mounting block 24 therethrough. Top plate 66 merges at bends into diagonally disposed lip 70 and side ears 72, each having an aperture 74 disposed therein.

The bottom bracket segment 30 comprises a single sheet of bent stainless steel comprising a plate or planar bottom layer or wall 76, which is interrupted by an aperture 78 in one corner from which a hollow snift spray drain pipe 80 extends. Aperture 78 and drain pipe 80 are aligned to accommodate drainage of condensation derived from moisture-laden air and carbon-dioxide issuing from fill valve of a filler when the valve snifter buttons are sequentially opened by reason of engagement with the cam 26 as explained below in greater detail.

Bottom wall 76 is illustrated as being of uniform thickness. Bottom wall 76 merges through a bend into vertically-disposed, high profile wall 86. Bottom wall 76 also merges through bends with an upstanding low profile distal lip 82 and with opposed side wall ears 84. Each side wall ear is interrupted by a threaded aperture 88, while back wall 86 is interrupted by two threaded apertures 90.

Figure 1:
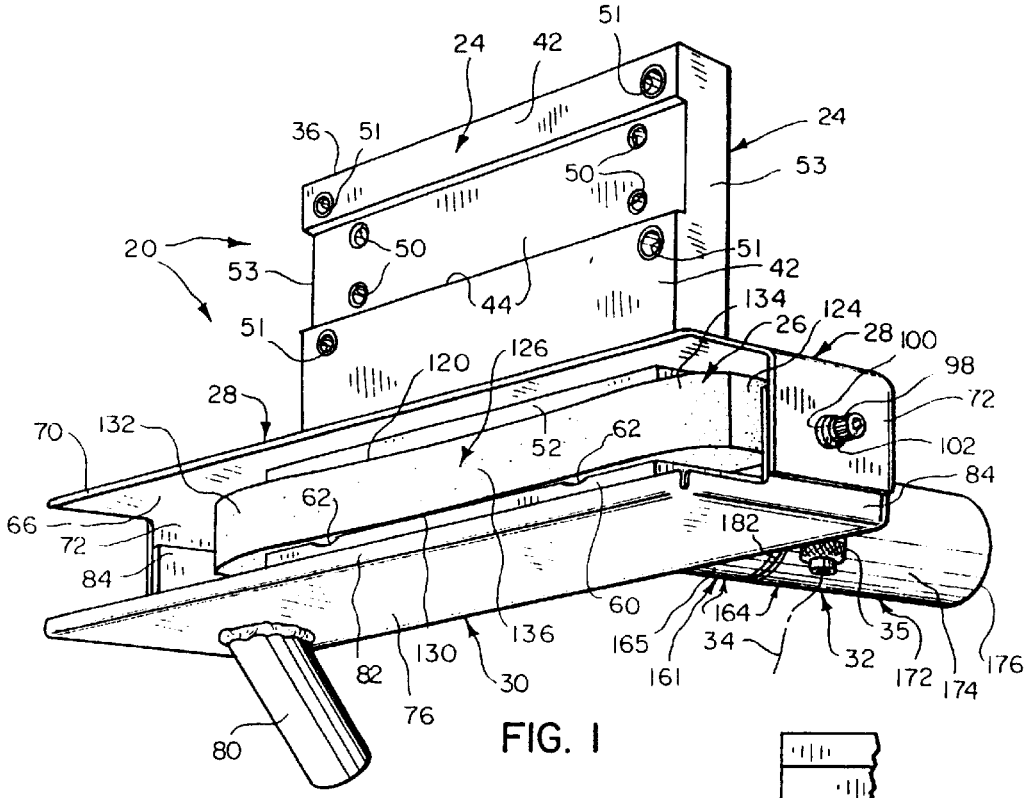
FIG. 1 is a perspective representation of a pre-fill snift cam assembly embodying principles of the present invention, viewed from the front.
Figure 2:
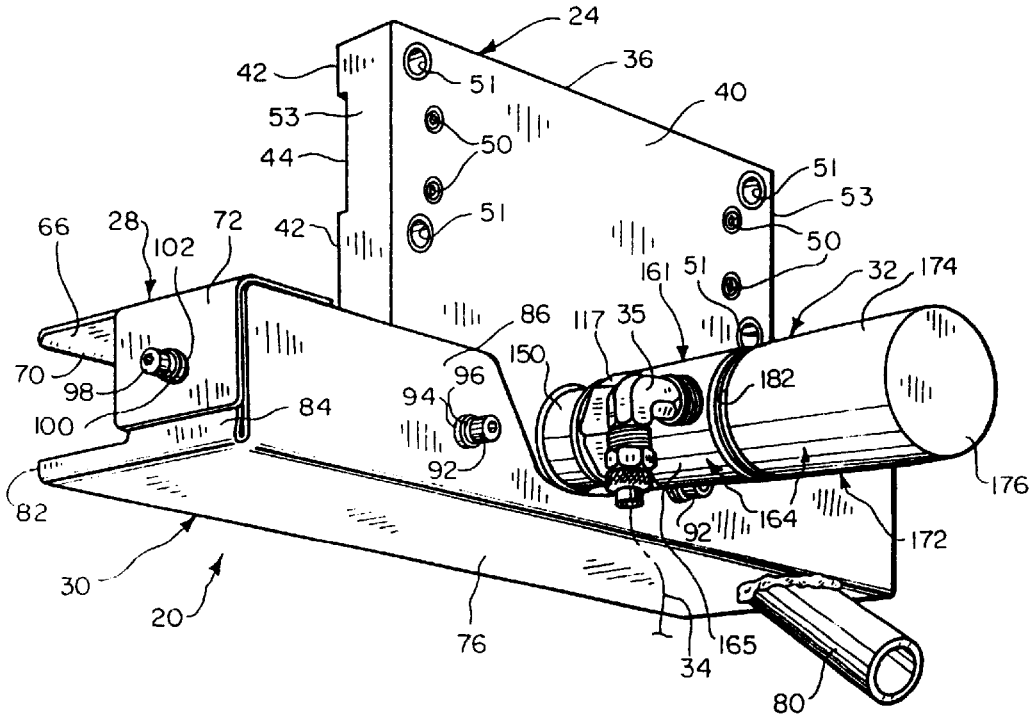
FIG. 2 is a perspective representation of the pre-fill snift cam assembly of FIG. 1, viewed from the rear.

The spacing between ears 72 is slightly greater than the spacing between ears 84, accommodating the assembled overlapping, contiguous and interconnected relationship shown in FIGS. 1 and 2.

When the cam assembly 20 is assembled, the bottom plate 62 carried by mounting body 24 is placed just above the top surface of bottom wall 76 of the bottom bracket segment 30 (FIG. 4) so that two threaded blind bores exposed at surface 40 are aligned with the two apertures 90, following which an allen head cap screw 92 is placed through each aperture 90 and turned into the aligned threaded bore of the mounting body 24, at surface 40, with a washer 94 and a lock washer 96 interposed between the head of the cap screw 90 and the back surface of the rear wall 86, until both cap screws 92 are firmly tightened, as illustrated in FIG. 2.

As briefly mentioned above, the top bracket segment 28 is positioned over and slightly above plate 52 (FIG. 4) so that each aperture 74 is aligned with one of the apertures 88, following which cap screw 98, with a lock washer 100 and a washer 102 mounted on a threaded shaft thereof, is inserted through aperture 74 and threaded upon the threads at aperture 88 to create the assembled bracket illustrated best in FIGS. 1 and 2. For clarity of illustration only one cap screw 92 and one cap screw 98 are illustrated in FIGS. 1 and 2.

Figure 4:
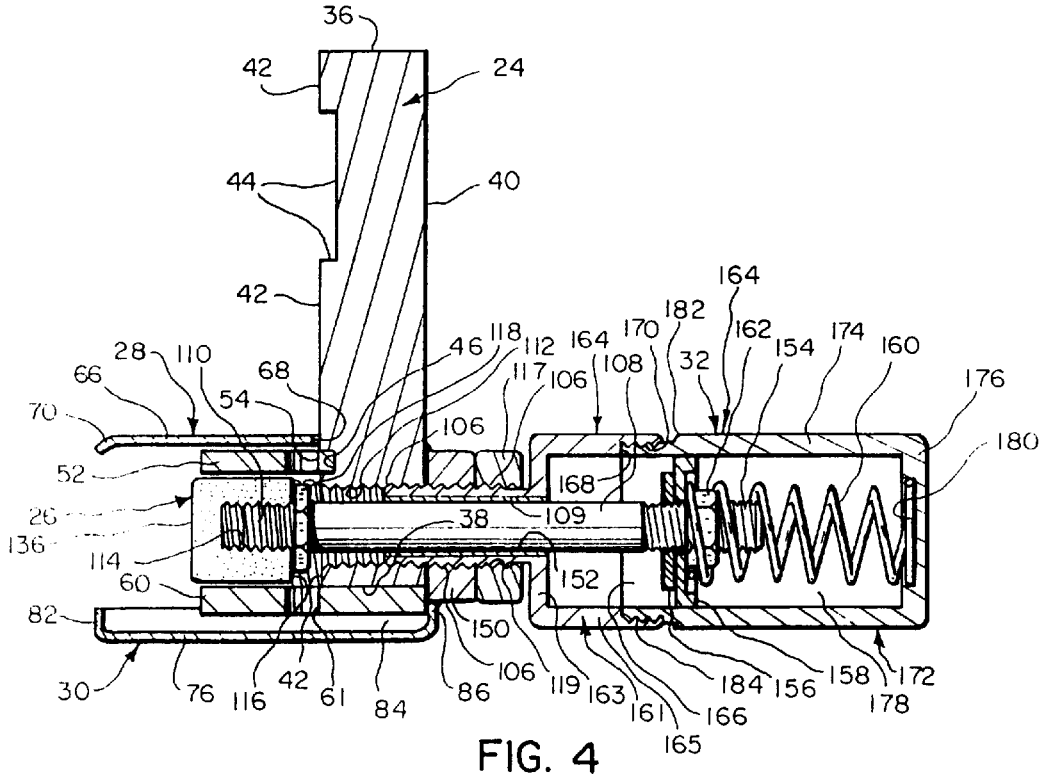
FIG. 4 is a longitudinal cross-sectional view of the air cylinder and related portions of the pre-fill snift cam assembly of FIG. 1.
Figure 3:
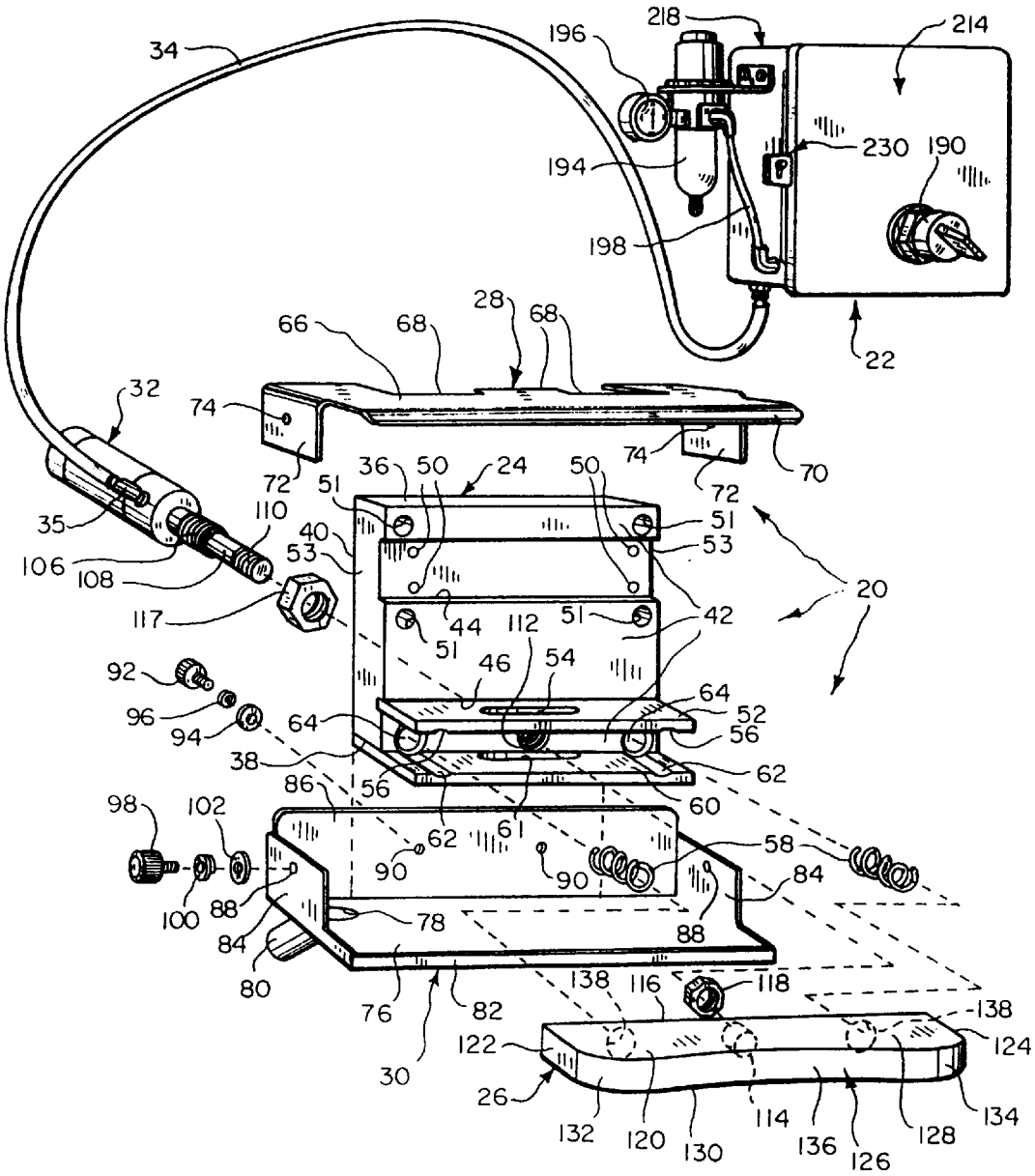
FIG. 3 is an exploded perspective of the pre-fill snift cam assembly of FIG. 1, viewed from the front.

The air cylinder 32 comprises a fixed threaded boss 106, non-rotatably secured to the external housing of the air cylinder, through which a piston shaft 108 reciprocates in a bushing 109 (FIG. 4). Piston rod 108 terminates in a threaded distal end 110. The air cylinder 32 is inserted distal end first into a threaded bore 112 in mounting block 24. Threaded bore 112 opens at surface 42. It also extends proximally within a boss 150 (FIG. 4) which projects beyond surface 40 (at a location midway between recesses 64 and centrally between plates 52 and 60). The air cylinder 32 is threaded at stationary boss 106 into threaded bore 112 to secure the two together in fixed, non-rotatable relation.

When the threads of boss 106 and those of bore 112 are snugly secured together, the piston rod 108 of the air cylinder 32 extends distally beyond the bore 112 between the plates 52 and 60. The nut 117 is tightened against boss 150 to secure the position. See FIG. 4. The threads at distal end 110 of the piston rod are threaded into a threaded blind bore 114 exposed at the back surface 116 of the cam 26. See FIG. 4. A nut 118 is first threaded onto the exposed distal end 110 of the piston rod 108 and, after the threads at 110 are secured in threaded blind bore 114, the nut 118 is tightened against the back surface 116 to lock the cam 26 in the assembled relation at the end of the piston rod 108. The cam 26 comprises an essentially flat bar 120 which is planar top, bottom, back and at the sides. Cam 26 has a substantial vertical depth thereby providing substantial weight for long-term use as hereinafter explained in greater detail. One suitable material from which the bar 120 may be formed is nylon-based material, such as Nylatron. The flat bar 120 comprises the previously mentioned planar back surface 116, two relatively short side surfaces 122 and 124, and the top and bottom surfaces 128 and 130. Bar 120 also comprises a twice-reversed curve camming surface 126, which distally traverses between side surfaces 122 and 124.

The camming surface 26 comprises spaced concave rounded regions 132 and 134, adjacent to edge surfaces 122 and 124, respectively, which accommodate gradual engagement between the snift button of each fill valve and the convex central surface 136 as each fill valve is rotated by the filler with an empty can contiguously beneath each fill valve reaching the cam 26 immediately prior to delivery of beverage into the can or bottle at the filling site. This is essentially at the same time as the can is counter pressured by the fill valve to drive air from the empty can into the air chamber of the associated fill valve. As the snift button 133 (FIGS. 8 and 9), which comprises an actuator for the associated snift valve 135, rides across the cam 26, the snift button 133 is depressed by reason of compressive engagement with convex abutment or camming surface 136 (when the cam 26 is extended). Air expelled from the empty can just prior to filling exhausts from the air chamber through the snift valve 135 associated with the snift button 133 to the atmosphere thereby preventing the air from conventionally traveling up the internal conventional counterpressure tube into the beverage bowl to thereby mix with the product and cause the previously mentioned problems associated with the introduction of such air into the finished product.

It is to be appreciated that the cam 26 is disposed in its extended, snift button engaging position due to the urging of an internal spring 160 (FIG. 4) when no elevated air pressure is present in the air cylinder 32. When air at elevated pressure is delivered to the air cylinder 32 from the control 22, it applies force to the distal side of an interior piston 158 displacing the piston 158 and piston rod 108 in a proximal direction thereby retracting the cam 26 out of the path of the snift button 133. Such retraction is counter to the forces imposed by springs 58 and spring 160 which urge the cam 26 in a distal direction. The distal ends of springs 58 are disposed in spaced recesses 138 located at back surface 116 of cam 26.

Figure 8:
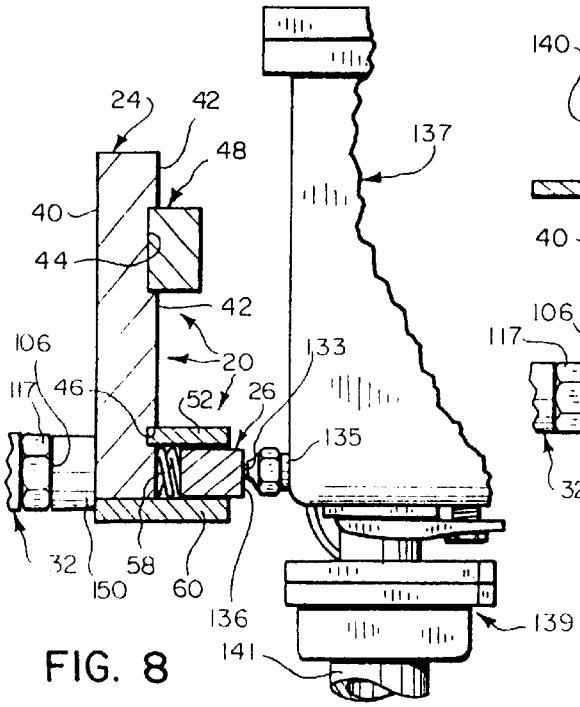
FIG. 8 is a fragmentary side view of the cam assembly of FIG. 1 mounted adjacent a Meyer filler having a snift button at the rear.
Figure 9:
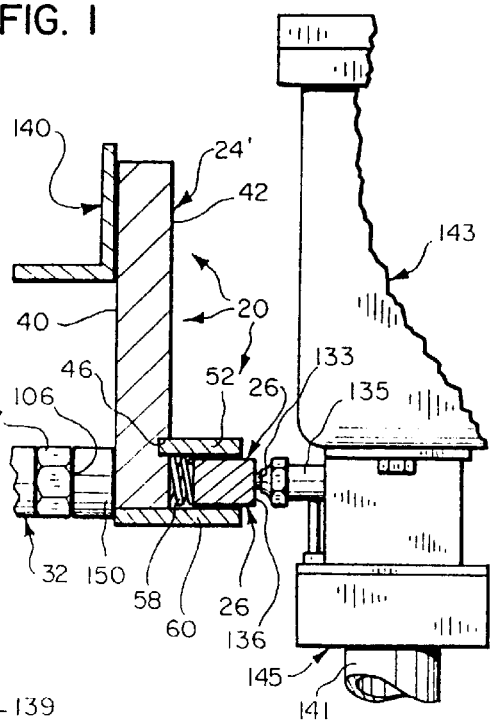
FIG. 9 is an elevational view of the cam assembly of FIG. 1 mounted for operation in conjunction with a Crown filler having a snift button at the rear.

When the cam assembly 20 is used with a Meyer filler, generally designated 137, the cam assembly 20 may be mounted as shown in FIG. 8. FIG. 8 illustrates also one conventional Meyers fill valve 139 with a container in the form of an empty can 141 elevated into sealed relation with the fill valve 139 for counterpressuring and filling.

Where the cam assembly 20 is to be used with a Crown filler, the U-shaped groove 44 and the apertures 50 may if desired be eliminated (as shown in FIG. 9) and the resulting mounting block 24' may be rigidly connected to an angle-shaped beam 140 by placing conventional fasteners through apertures 51 into the mounting body 24' and through correspondingly placed apertures in L-shaped beam 140. When the cam assembly 20 is used with a Crown filler, generally designated 143, the cam assembly 20 may be mounted as shown in FIG. 9. FIG. 9 illustrates also one conventional Crown fill valve 145 with a container in the form of an empty can 141 elevated into sealed relation with the fill valve 145 for counterpressuring and filling.

It is to be appreciated that bracket segments 28 and 30, among other things, are removed from FIGS. 8 and 9.

Reference is now made to FIG. 4 which illustrates the interior nature of the air cylinder 32. The previously mentioned threaded bore 112 in mounting body 24 extends not only through the mounting body 24, but also through the reinforcing boss 150, which is welded or otherwise suitably non-rotatably connected to the mounting body 26. Thus, the threaded region 106 of the air cylinder 32 is threadably secured not only within the threads of bore 112, but the threads of boss 150, as illustrated in FIG. 4. Also as mentioned earlier, nut 117, which has a threaded bore 119, is turned upon the threads 106 so as to lock the threaded inner-connection into a secure, stationary, and non-rotatable relationship. Piston rod 108 thus reciprocates within the smooth bore 152 of the bushing 109.

The concealed proximal end 154 of the piston rod 108 comprises threads upon which a nut 156 is first threaded to a suitable location along threads 154. A piston 158, illustrated as having a cup-shape, is next linearly placed over the threaded end 154 so as to be proximally contiguous with the nut 156. A coiled biasing spring 160 is positioned proximal of the piston 158 so that the distal end of the spring contiguously abuts a proximal surface of the piston 158. Piston 158 seals peripherally against the external housing of air cylinder and against threads 154. A proximal nut 162 is thereafter threaded upon end 154 so as to snugly compressively engage the piston 158 on the proximal side thereof to tightly trap the piston 158 in the position of FIG. 4.

The threaded boss 106 merges as one piece with a distal housing 164 at radial wall 163. Housing 164 comprises two housing segments, i.e., 161 and 172. Housing segment 161 defines a hollow interior in the nature of a sealed air chamber 166. Air chamber 166 receives air under suitably elevated pressure from tube 34 through fitting 35 whereby air chamber 166 is selectively pressurized for purposes hereinafter explained in greater detail.

Radial wall 163 of housing segment 161 merges as one piece with annular wall 165. The interior diameter of distal housing segment 165 is substantially the same as the outside diameter ot the piston 158. Housing segment 165 is stepped at shoulder 168. Shoulder 168 merges with interior annular threads 170, the mean diameter of which is slightly greater than the inside diameter of the housing segment 165.

Proximal housing segment 172 comprises an annular wall 174 and a radial end wall 176 formed as one piece. Walls 174 and 176, together with piston 158, define a hollow chamber 178 in which the coiled bias spring 160 is disposed. To maintain position and spring alignment, the proximal end of the spring 160 is located within an annular recess 180 fashioned in the distal interior face of the wall 176 at chamber 178. Chamber 178 is closed but the trapped air therein accommodates sufficient proximal displacement of the piston 158 to place the cam 26 in its retracted, disabled position.

The exterior of wall 174 is distal stepped at shoulder 182. Shoulder 182 merges with distally extending threads 184, which tightly threadably engage threads 170 to both unite housing segment 161 with housing segment 172, but also to seal chambers 166 and 178 (except for air displaced between the hollow interior of tube 34 and the chamber 166 through fitting 35.

In operation, spring 160 of air cylinder 32 at all times urges the cam 26 to its extended, snift button-engaging position, as do springs 58. The force of springs 58 and 160 succeeds in placing the cam 26 in its extended position when air chamber 166 is not pressurized. When the air in chamber 166 is pressurized, the force of the air pressure in air chamber 166 is greater than the force of springs 58 and 160, causing the cam 26 to be retracted into its disabled position away from the snift button 133, counter to the force of spring 160.

Thereafter, when air pressure applied through tube 34 and fitting 35 is discontinued, the pressure in chamber 166 is dissipated back through fitting 35 and the hollow interior of tube 34.

Figure 7:
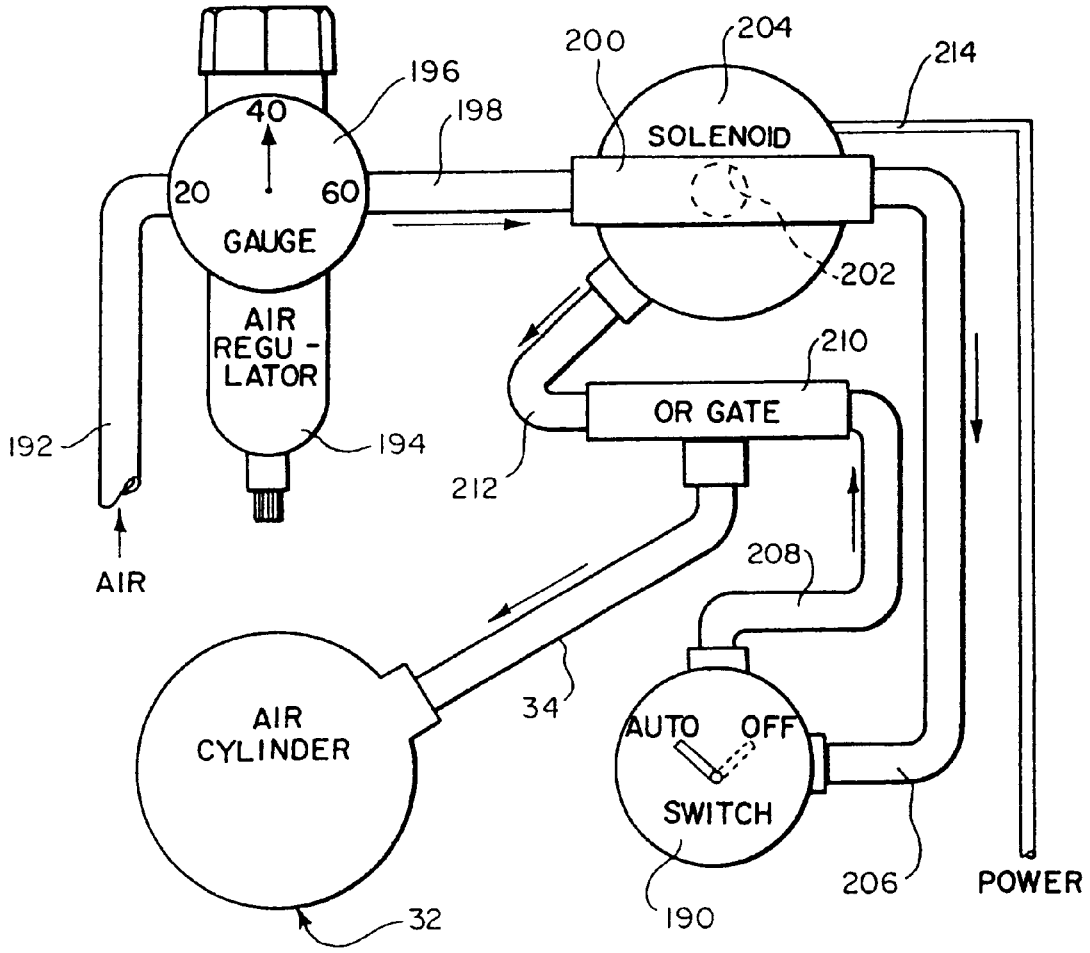
FIG. 7 is a fluidic circuit diagram.

Reference is now made to the control circuit illustrated schematically in FIG. 7. As stated previously, air cylinder 32 extends the cam 26 into its enabled position by force of the internal spring 160 contained within the air cylinder 32 and cam springs 58, when the air cylinder is starved for air under pressure.

To the contrary, notwithstanding the force of the springs, communication of air under pressure, at a predetermined elevated pressure typically in the range of 40 to 50 psi via tube 34, causes the cam 26 to be retracted into its disabled position in the manner explained above.

There are two ways by which air under pressure may be communicated to the hollow interior of tube 34 and thus to the air chamber 166 within the air cylinder 32. First, when the pneumatic switch 190 is manually placed in the OFF position, air under suitable pressure is caused to reach the hollow interior of tube 34 in the following way: air under suitable pressure from a source (such as a compressor) is communicated along the hollow interior of tube 192, across an air regulator 194 so that the pressurized air is sensed by gauge 196, to solenoid supply tube 198. Air under pressure in tube 198 is communicated to a T-fitting 200 and from thence to an inlet port 202 of a solenoid and independently to the hollow interior of tube 206. The air under pressure in tube 206 is communicated across switch 190 only when switch 190 is in the off position. Air under pressure traversing switch 190 is communicated to the hollow interior of tube 208, across pneumatic or gate 210 to the hollow interior of tube 34 and thence to the interior air chamber 166 of air cylinder 32 to retract the cam 26.

Typically, the switch 190 is manually positioned in the OFF position rarely and then only when it is desired to sanitize the filling equipment.

Normally, switch 190 is manually positioned in the AUTO position which starves the hollow interior of tube 208 ot air under pressure, notwithstanding the fact that the hollow interior of tube 206 is subjected to air under pressure. When tube 208 is starved for air under pressure, no air under pressure from tube 208 can be communicated across or gate 210 along the hollow interior of tube 34 to the air chamber of cylinder 32.

Solenoid 204 is a commercially available normally closed solenoid which receives power via conductor 214 at all times when the filling machinery is operating normally. The power delivered to the solenoid 202 continuously biases an internal piston of the solenoid to a closed position counter to the force of an internal biasing spring. This places and retains cam 26 in its extended enabled position because air cylinder 32 is starved for air under pressure, switch 190 being in the AUTO position.

When power to the solenoid 204 is discontinued, due to an abnormality in the operation of the filling machinery, for example, the electronic bias on the internal piston of the solenoid 204 is removed, allowing the internal spring to displace the internal solenoid piston to its open position thereby delivering air under pressure from the solenoid 204 to the air chamber 166 of the air cylinder 32 via tube 212, or gate 210, and tube 34.

The electrical power delivered by conductor 214 may be 120 volt AC.

Power delivered along wire 214 is discontinued when the emergency or panic stop button on the filling equipment is actuated. When electrical power is so discontinued, the hollow interior of tube 212 is pressurized causing the cam 26 to be retracted into its disabled position. This prevents flooding of the bowl when cans or bottles are under the fill valves of the filler. Power to conductor 214 may be discontinued from one or more sites other than the panic stop button as appears reasonable or desirable to those skilled in the art.

Figure 5:
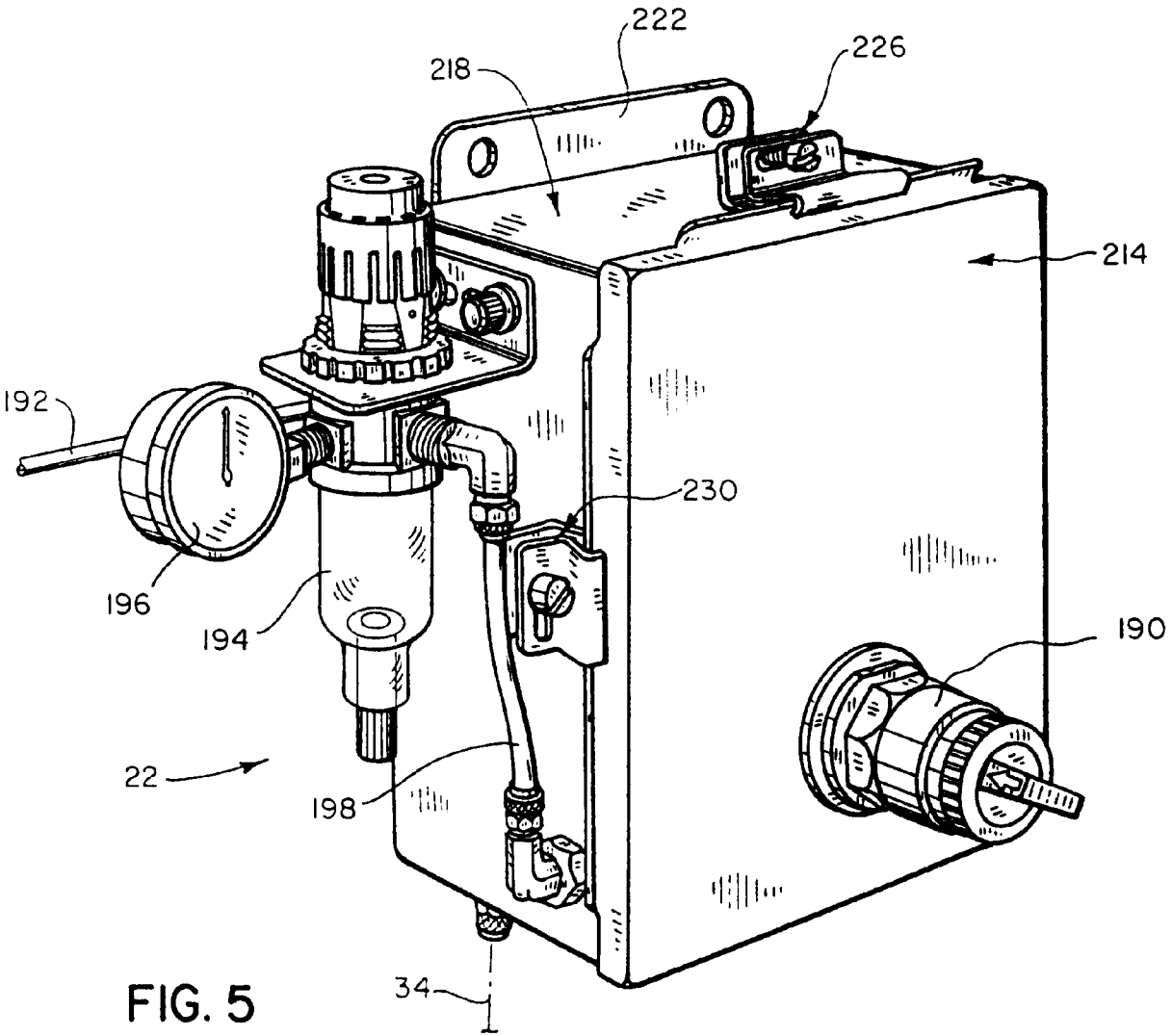
FIG. 5 is a perspective representation of a control box by which the cam of the pre-fill snift cam assembly of FIG. 1 is extended and retracted, the control box being shown in its closed position.
Figure 6:
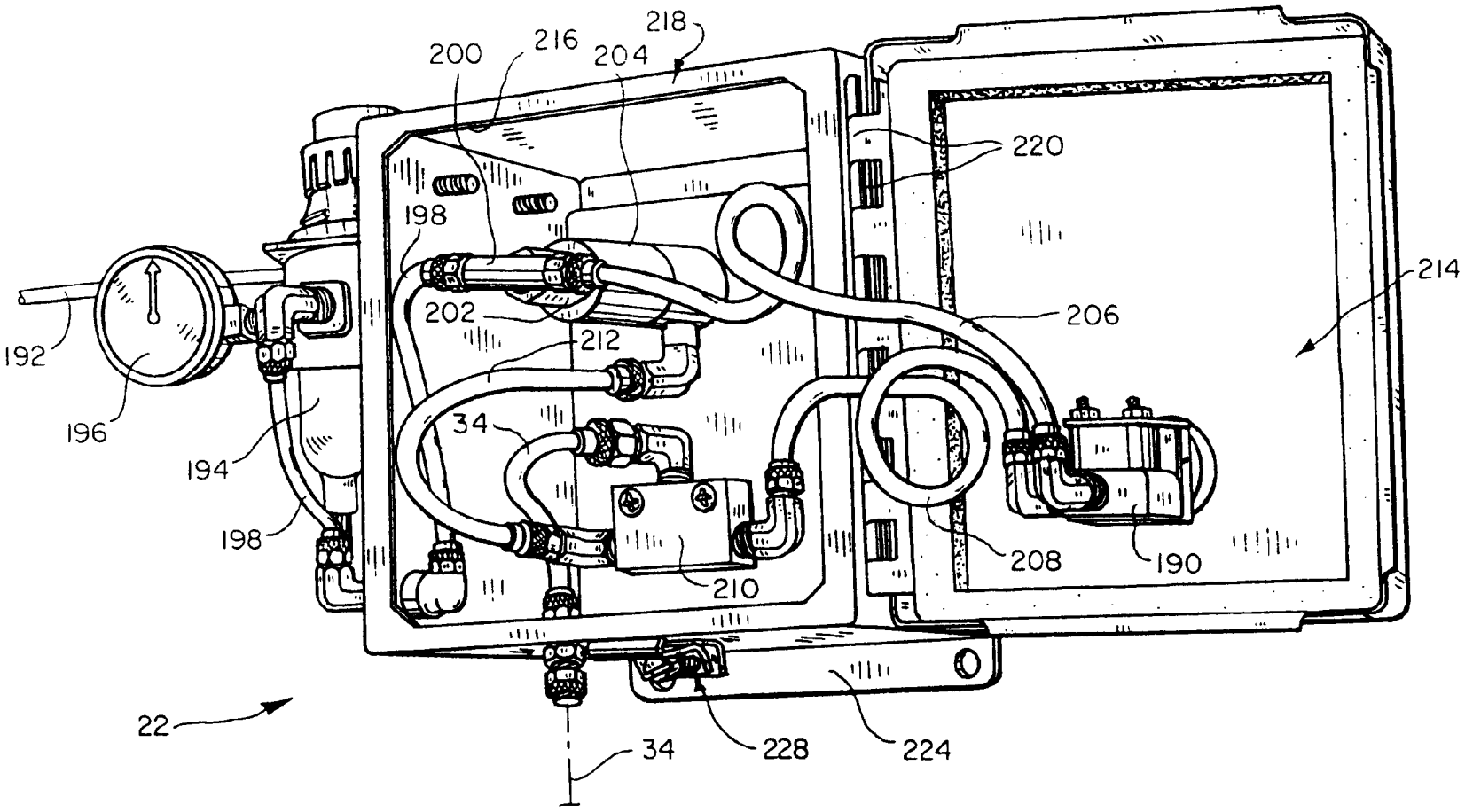
FIG. 6 is a perspective representation of the control box of FIG. 5, illustrated in its open position.

The components of the control circuit of FIG. 7 are carried within or upon the control box 22, as best illustrated in FIGS. 5 and 6 to which reference is now made. As can be seen from inspection of FIGS. 5 and 6, the mounting of the components of the control circuit to the control box 22 is conventional and can be ascertained by inspection. No further description is, accordingly, necessary to an understanding of one of ordinarily skill in the art.

The control box 22 is conventional and preferably formed of metal, such as stainless steel. It comprises a front lid 214, which is hinged to and used to close a front opening 216 of a rectangular shaped receptacle 218. The gauge 196 and regulator 194 are shown as being exteriorly mounted to one side wall of the receptacle 218 opposite the hinge 220 interposed between the lid 214 and the receptacle 218. The switch 190 is illustrated as being mounted to the lid 214 so that the actuator is exposed at the outside surface of the lid 214 and the switch itself is disposed at the interior surface of the lid 214.

The solenoid 204 and the or gate 210 are illustrated as being mounted to the receptacle 218 within the hollow interior thereof. The various hollow tubes of the control circuit, with the exception of one section of tube 198 and another section of tube 34, are located within the control box 22, when closed. Fittings between tube sections and between a tube section and a component are provided to accommodate the connections described above. These fittings are conventional and well-known and, therefore, do not need to be explained in detail. All tubes may be formed from ¼" polyflo tubing.

The receptacle 218 is equipped with a back wall comprising exposed top and bottom mounting flanges 222 and 224. Exposed flanges 222 and 224 are apertured to accommodate mounting to a desired fixed location, such as adjacent to the control panel for the filling machinery.

The control box 22 is illustrated as being equipped with a top, a bottom, and a side latch 226, 228, and 230, respectively. These latches are conventional and may be tightened or loosened to secure the lid 214 in a closed position or to accommodate opening of the lid 214 in a manner well understood by those skilled in the art.

Or gate 210 may comprise a 2500 Schrader Bellows Model No. 1641001.

The pneumatic switch may comprise two parts placed in tandem, i.e. Aro Corporation Model Nos. 59066-10 and 59064. The air regulator may comprise a Schrader Bellows Product No. 14E11B13FASB. The gauge may comprise a conventional Marshall Town pressure gauge. The solenoid may comprise a Schrader Bellows Model No. 755830115-100MOPD BA9.

Fill Valves, Nozzle Adapters, and Front Snift Valve

Reference is made to FIGS. 10 through 18A for the purpose of describing novel nozzle adapters retrofitting to existing fill valves, novel fill valves, and novel combinations of fill valves and snifters.

Figure 10:
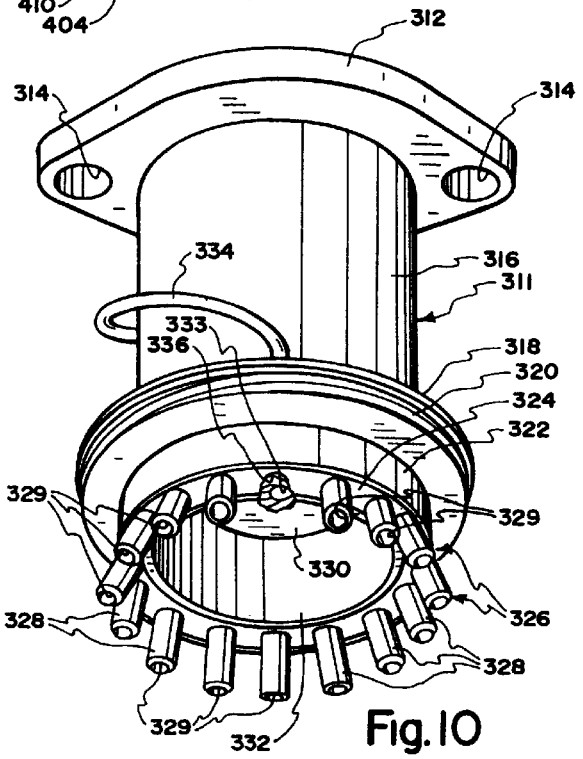
Fig. 10 (PRIOR ART)
FIG. 10 is a perspective representation, as viewed from a relatively low position, of a lower end of a prior art commercial beverage fill valve (with a can-engaging seal or gasket removed for purposes of clarity) used with existing automated canning machinery, by which cans of a known size were filled to a predetermined level with a beverage.

Reference is now specifically made to FIG. 10, where the lower portion of a prior art fill valve, generally designated 311, is illustrated in perspective from a location beneath the valve. Fill valve 311 is intended to be illustrative only, as there are other fill valves presently in commercial use which are constructed somewhat differently, but serve the same purpose in much the same way as fill valve 311, shown in FIG. 10. Traditionally, such fill valves are formed from stainless steel. In each such commercial fill valve, distal discharge nozzle structure is used which comprises a circular array of tubes from which a plurality of downwardly and outwardly directed beverage effluent flow paths are defined, each of which is substantially circular in cross section. As few as nine and as many as fifteen rubes have been commercially used in the past. The number of influent flow paths within these fill valves is equal to the number of effluent flow paths. Accordingly, the fill valve 311, illustrated in FIG. 10, is illustrative of some of the problems posed by the prior art.

Conventional fill valve 311 specifically comprises a top flange 312, which comprises apertures 314 by which the fill valve 311 is mounted to beverage machinery in a conventional fashion and for well-known purposes. Fill valve 311 comprises a hollow cylindrical wall 316 through which beverage, such as a carbonated drink or beer, selectively flows. The hollow cylindrical housing 316 merges into an integral radially extending flange 318. Flange 318 comprises internal beverage passageways and exposed threads 320, by which the fill valve 311 is positioned as part of the aforementioned beverage machinery. Flange 318 integrally merges with a downwardly directed, integral annular boss 322 through which the internal beverage flow passageways continue.

The lower surface 324 of the boss 322 is illustrated as being angularly tapped at fifteen separate sites, as illustrated, to accommodate interference fit insertion of each of an array 326 of beverage discharge nozzle tubes 328. Each nozzle tube 328 is in communication with one of the internal beverage passageways disposed in flange 318 and boss 322. Each tube 328 of the array 326 is, thus, diagonally disposed in a downward and outward direction and internally comprises a single, angularly oriented, linearly extending central bore 329. The tubes 328 collectively define a maximum diametral size in the form of array 326 which, on a close tolerance basis, is adapted to fit through the top opening at the upper lip or edge of a beverage can of a predetermined size having a larger top opening. The sizing and orientation of the array 326 of nozzle tubes 328 accommodates not only insertion through the open top of a can but also selective discharge of beverage into the can by directing the beverage as a plurality of circular streams against the interior surface of the side of the can near the top thereof. This maintains foaming of the beverage within tolerable limits for cans having larger top openings.

The fill valve 311 also comprises a central radially-directed wall 330 apertured at 333 for introduction into the can of pressurized gas prior to delivery of beverage and progressive evacuation of pressurized gas from the can during filling. Interior cone-shaped surface 332 is centrally disposed above the boss 322 and defines a downwardly and outwardly conically tapered hollow interior substantially parallel to and disposed within the collective orientation of the array of 326 of nozzle tubes 328. A conventional liquid dispensing valve operates within the hollow formed by surface 332 to selectively shut off gas flow to equalize pressure and insure proper head space and liquid volume in the can being filled by valve 311.

Fill valve 311 also comprises a separate, exteriorly disposed helical snift tube 334, the hollow of which functions to snift gas from the top of the can at the conclusion of beverage filling before removing the can from the filling equipment. The hollow of tube 334 communicates selectively with a gas passageway disposed through flange 318 and boss 322. This gas passageway has a port located adjacent the slot 336 whereby, in accordance with conventional operation of the aforementioned beverage machinery, pressurized gas at the top of the beverage-containing can is evacuated therefrom or snifted just before the filled can is removed from the filling machinery.

Because of the close tolerance relationship between the opening of predetermined size at the top of a specific can to be filled with beverage and the diametral size of the nozzle array 326, reduction in the size of the opening at the top of a beverage can creates a significant dimensional interference problem. See U.S. Pat. No. 5,141,035 for more details in respect to this problem.

As mentioned earlier, the aforementioned dimensional interference problem has, in the past, been resolved by simply discarding the entire existing supply of fill valves associated with an automated canning facility and fabricating new fill valves having close tolerance dimensions which will accommodate passage through the diametrally-reduced opening of the can. The expense of doing this for each or nearly each top opening size change is very substantial and may well be cost prohibitive for at least some canned-beverage producers.

As explained hereinafter, the present invention offers an answer to the reduced can opening/lid size problem mentioned above. To implement the present invention in one way as opposed to others, the boss 322 and the nozzle tubes 328 of valve 311 are removed from the proximal remainder of the fill valve 311, that proximal remainder being designated by the numeral 311' in FIGS. 11, 14, and 15. This is preferably done by utilization of standard machining techniques, which need not be described here.

Since the hollow interior of each distal nozzle tube 328 communicates with a proximal liquid passageway, which initially extends through the flange 318 and the boss 322, removal of boss 322 and nozzle tubes 328, as by machining, creates a flat, radially directed surface 352 (FIG. 1) and leaves an exposed array of beverage passageway ports 350, each located along a common radius from the center of the flange 318. Likewise, a pressurized gas passageway port 354, in which the hollow of the tube 334 is in fluid communication, is similarly exposed at a specific location at the new surface 352 of flange 318. The port 333 also remains.

The flange 318 is further tapped at a plurality of predetermined sites 356 for receipt of fasteners. In the illustrated embodiment, the tapped sites 356 are threaded to receive fasteners.

An adapter nozzle, embodying the principles of the present invention, is mounted upon the proximal remainder of modified fill valve 311' in contiguous relation with surface 352. While the exacted nature of the adapter nozzle may vary within the scope of the present invention, one presently preferred adapter nozzle, generally designated 360, is illustrated in FIGS. 12, 13, 14, and 16. The adapter nozzle 360 may be formed primarily as a single die cast or machined piece of stainless steel, although other materials, such as synthetic resinous material may be predominantly used, where desirable and appropriate. Adapter nozzle 360 is specifically configurated to be mounted upon either a Crown fill valve or a Cemco fill valve, after being modified as described in connection with and as shown in FIG. 11, but certain principles of adaptation, in accordance with the present invention, apply to such modifications of all commercially existing fill valves.

Adapter nozzle 360, shown best in FIGS. 12, 13, 14, and 16, is generally annular in its configuration, having a tapered hollow interior, at 363 (through which pressurized gas from port 333 passes), and a stepped exterior. The body of material comprising adapter nozzle 360 comprises a top flange 362. Flange 362 has a uniform outside diameter illustrated as being just smaller than the diameter at threads 320 of the flange 318. Preferably, as shown in FIG. 11, surface 352 is recessed so that an annular downwardly extending lip 364 is formed, the bottom surface of which is essentially flush with the bottom surface 366 of the flange 362 (FIG. 16).

The flange 362 is illustrated as being of uniform thickness and terminates in an annular edge 368. Flange 362 is apertured at six sites 370 (FIG. 12). The apertures 370 are selected so as to be aligned with threaded bores 356 when the adapter nozzle 360 is assembled. Consequently, when assembled, each aperture 370 is aligned with a threaded bore 356 for receipt of an Allen head screw 372, or other suitable fastener. The threaded end of each Allen head screw 372 fits loosely through the associated aperture 370 and threadedly engages the threads of the associated bore 356. Each aperture 370 is shown as being counterbored at the lower surface 366 of the flange 362 so that the exposed part of each Allen head fastener 372 is essentially flush with surface 366 upon installation. As a consequence, the adapter nozzle 360 is securely fastened to the remaining proximal portion of the modified fill valve 311' in operative relation, as shown in FIG. 11.

As best seen in FIG. 16, the adapter nozzle 360 comprises a top surface 376, which is planar or flat and extends across the entirety of the adapter nozzle 360 at flange 362. The top surface 376 is interrupted by two annular grooves 378 and 380 and an annular recess 382 (FIG. 13). An appropriately-sized O-ring is positioned within each of the grooves 378 and 380 and the annular recess 382, as best illustrated in FIGS. 13 and 16. The mentioned two O-rings 379, 381, and 377 constitute the manner in which the adapter nozzle 360 is sealed to the modified fill valve 311' at surface 352, when assembled, against beverage and pressurized gas leakage. If desired, depending upon the composition and nature of the beverage being dispensed through the adapter nozzle 360, an annular single screen 390 (FIG. 13) is superimposed upon the top surface 376 between the grooves 378 and 380 for filtration of beverage and, in the case of beer, for accommodating surface tension shut off of a beverage flow and to lessen complications due to beer stone.

The top surface 376 of the adapter nozzle 360 is shown as being diagonally interrupted by a snifter port 392 within recess 382 between O-ring 377, to accommodate novel counterpressure discharge and snift flow. The counterpressure discharge and snift flow are explained below. The O-rings 379, 381, and 377 in grooves 378 and 380 and recess 382 seal against beverage loss. Before beverage is introduced into the can through the adapter nozzle 360, pressurized gas is delivered to the can from the beverage bowl via port 333 and hollow 363 drives residual air in the can to the atmosphere through port 392 and a counterpressure discharge snift valve assembly 462, as opposed to delivering the can-derived air to the beverage bowl via hollow 363 and port 333, as is traditional.

The conically-shaped hollow interior 363 of the adapter nozzle 360 helps to minimize the amount of material used in fabricating the adapter nozzle 360. The frusto-conically-shaped hollow 363 is interrupted by two ports 383 and 385. See FIG. 16.

The top surface 376 of the adapter nozzle 360 is further interrupted by an annular beverage flow dwell groove or beverage merging or collecting chamber 400, which is disposed along a single radius band from the center line of the adapter nozzle 360 between the O-ring grooves 378 and 380. Groove 400 comprises a transitional chamber at which flow from each of a plurality of influent flow paths in proximal valve portion 311' is combined, passed through screen 390, and introduced into each of a plurality of effluent passageways 402 via port 401. Passageways 402 are illustrated as being circular in cross-section. The number of effluent passageways illustrated exceeds the number of influent tubes. Specifically, FIG. 11 illustrates fifteen influent tubes 350, while FIG. 13 illustrates twenty-four effluent passageways 402. Other ratios can be used. Thus, beverage is displaced, under force of the beverage-canning machinery mentioned above, downwardly from the fifteen ports or passageways 350 into chamber 400, through the single arcuate screen 390 and into the twenty-four passageways 402 via ports 401. Each passageway 402 merges with a continuous single beverage discharge groove 404 at an angular transitional location 408. Groove 404 has a sharper radial angle than passageways 402.

As a consequence, the overall maximum diametral size of the adapter nozzle 360 below the flange 362 is of reduced size so as to accommodate displacement through the progressively smaller top openings of cans. Yet issuance of beverage emanating from the groove 404 is directed angularly as a thin layer against the interior surface of the sidewall of the can at an elevated location so that foaming is within tolerable limits. Sloped passageways 402 and outwardly and downwardly directed annular diagonal groove 404 may be formed in stainless steel by casting or by machining.

The adapter nozzle 360, as stated, is illustrated as being primarily of one piece construction (excluding a few components, such as the screen 390 and O-rings 379, 381, and 392) and comprises, as best shown in FIG. 16, a bottom radially-directed annular planar surface 412 in which each groove 404 is located. Surface 412 integrally merges with interior frusto-conical surface 363 at an annular corner 414. Surface 412 also integrally merges at annular outside corner 417 with an exterior annular flange-like surface 416, which is illustrated as having a uniform diameter. Surface 416 integrally merges at outside corner 418 with diagonal surface 420. Diagonal surface 420 merges at inside corner 422 with annular surface 424. Surface 424 is of uniform diameter and integrally merges with diagonal surface 426 at inside corner 428.

Diagonal surface 426 merges with annular surface 434 at outside comer 430. Annular surface 434 is illustrated as being of uniform diameter throughout. Surface 434 integrally merges with the lower surface 366 of flange 362 at inside corner 436.

Even though the composite refurbished fill valve comprising proximal portion 311' and distal portion 360 has been described above as being comprised of a modified though pre-existing proximal portion and a new distal nozzle portion, both portions can be of new construction. The resulting fill valve can be fabricated so that the proximal and distal portions are substantially formed as one piece or as two or more pieces consistent with the abilities of those skilled in the art.

With particular reference to FIGS. 15 and 15A, a novelly configurated elastomeric seal or can edge-engaging gasket 454 is provided and is stretched superimposed upon certain parts of the exterior of the adapter nozzle 360 and released to be retained by the memory of the material from which the gasket is made. When assembled, gasket 454 is interiorly contiguous with the surfaces 366, 434, and 426, but is spaced somewhat from surfaces 424 and 420 by engagement between spacer or tab portions 455 of the seal 454 and surface 424 and/or 420. In the assembled condition, spacers or tabs 455 create three arcuate slots or spaces 457 (FIG. 15A), which allows selective flow of $CO_2$ counterpressure gas through port 383, as does the passageway 363.

Elastomeric seal 454 is comprised of a suitable elastomeric material, well known to those skilled in the art, and comprises an exposed annular flange 456 the maximum diameter of which is substantially equal to the diameter of flange 362. The flange 456 comprising a lower, radially-directed surface 458. Below the seal flange 456 is disposed a reduced diameter annular surface 460, the diameter of which is somewhat greater than the reduced size top opening of a can to be filled. Surface 460 merges with an inwardly and downwardly tapered lower surface 462'. Tapered or diagonal surface 462' serves to physically compressively engage the top edge of the can to be filled to create a liquid and gas seal to prevent inadvertent escape of either pressurized gas or beverage from the can across the gasket 454 without damaging the can during filling and snifting. The diagonal surface 462' merges with the hollow interior of the seal 454 at lower annular comer or edge 464 from which the three spacers 455 extend radially inwardly at 120° intervals. The hollow interior of the seal is configurated so as to match the external configuration of the adapter nozzle 360, as described above. The hollow interior of the beverage can seal or gasket 454 seals against the above-mentioned exterior surfaces of the adapter nozzle 360 so that gas or liquid leakage between the adapter nozzle 360 and the seal 454 cannot occur, except as otherwise indicated herein in respect to port 383.

While counterpressure $CO_2$ is introduced through the central interior within wall surface 363 into the can just prior to receiving beverage, concurrent secondary counterpressure flow is also accommodated through port 383 and gasket slots 457.

Also, counterpressure air discharge and snifting occurs through port 385, along snift passageway 387 (FIG. 13A), out port 392 and thence to a front counterpressure discharge/snift valve assembly 462.

Reference is now made to FIG. 17, which illustrates another form of the present invention and particularly a modified version of the proximal portion of a fill valve, which is generally designated 311". With few exceptions, the distal fill valve portion 311" of FIG. 17 is substantially similar to the proximal fill valve portion 311', shown in FIG. 11. Accordingly, the parts of distal portion 311" which are the same as those of distal portion 311' are correspondingly numbered in FIG. 17 and no further description thereof is needed.

Proximal fill valve portion 311" differs from fill valve portion 311 in that snift tube 334 has been eliminated, as has snift tube port 354. New counterpressure discharge/snift port 460 has been added to proximal fill valve portion 311" in FIG. 17, as has front counterpressure discharge/snift valve assembly, generally designated 462. Counterpressure discharge/snift valve assembly 462 is illustrated as being welded to the exterior of hollow cylindrical wall 316 immediately above flange 318. The conventional rear snift valve assembly has been eliminated.

As can be seen from FIGS. 18 and 18A, counterpressure discharge/snift port 460 communicates counterpressure discharge and snift discharge received from passage 387 to an upwardly directed passageway 464. See FIGS. 18 and 18A. Passageway 464 is disposed within the wall 316. At 90° comer or merge site 466, which is horizontally aligned with front counterpressure discharge/snift valve assembly 462, vertical passageway 464 merges with horizontal passageway 468. Passageway 468 communicates with an interior normally closed valve of the counterpressure discharge/snift valve assembly 462, in the manner explained herein.

The counterpressure discharge/snift valve assembly 462 comprises a generally rectangular body 470 of material such as stainless steel. Passageway 468 is disposed in valve body 470 and extends generally in a horizontal direction along a radius line from the center line of proximal portion 311". The counterpressure discharge/snift valve 462 is disposed in part within body 470 and partly outside of body 470 as best seen in FIG. 18A.

Valve assembly 462 comprises a plunger 474 which comprises an exposed distal end 476, also known as a snift button, and an internal proximal end 478. Plunger 474, at central portion 486 thereof, reciprocates within the hollow bore 480 of member 472 responsive (a) to depression due to engagement between the distal end 476 and each of two cams, such as described above in respect to FIGS. 1 through 9, and (b) to the bias of a compression spring 482 when neither cam is not engaged. Plunger 474 may be formed of a commercially available suitable synthetic resinous material.

The distal end 476 comprises a dome-shaped end or tip surface 484, which is periodically and sequentially engaged by each of the two cams. The central generally cylindrical shaft portion 486 of plunger 474 does not have a uniform diameter throughout but rather at least one and preferably two opposed flats 477 to accommodate counterpressure discharge and snift discharge therealong when plunger 474 is depressed. Nevertheless, cylindrical portions of plunger 474 engage contiguously the cylindrical surface comprising bore 480, thereby accommodating the above-identified aligned reciprocation of plunger 474 in bore 480.

The proximal end 478 of plunger or actuator 474 comprises a diametrally enlarged flange 488 reciprocably located within a valve chamber 490. The diameter of flange 488 is substantially greater than the diameter of bore 480. Chamber 490 comprises a cylindrical cavity formed within the proximal end 471 of member 472. Chamber 490 is defined in part by an annular surface 492, a radial abutment surface 494, and a proximal opening 496. The diameter of surface 492 is greater than the diameter of plunger flange 488, which is greater than the diameter of plunger-receiving bore 480.

An O-ring 498 is interposed between radial surface 494 and flange 488 around plunger portion 494 to both selectively (a) seal the interface between central portion 486 of plunger 474 and the surface defining bore 480, and (b) cushion or dampen the impact upon surface 494 when the plunger 474 is released from its depressed or retracted position and caused to return to its extended position by the force of spring 482. Thus, O-ring 498 and flange 488 collectively function as a stop which limits the extent to which the distal end 476 of plunger 474 extends beyond member 472 when not engaging cam surface 132.

The proximal end 478 of plunger 474 also comprises a cylindrical trailing portion 500, which is disposed in chamber 490 and surrounded snugly by one end of the compression spring 482.

An apertured plug 502 is compression fit, at O-ring 504, within the straight bore opening 496 to chamber 490 prior to placement of the valve assembly 462 into member 470. Plug 502 comprises an enlarged trailing flange 508, the diameter of which is greater than the diameter of surface 492, but less than the diametral size of threaded bore 510 in member 470 (into which valve assembly 462 is threadedly inserted). Threaded bore 510 matches and mates with threads 512 located along the exterior surface of the proximal end 518 of member 472 adjacent to chamber 490.

Plug 502 further comprises a reduced diameter cylindrical portion 514 immediately forward of flange 508. The diameter of portion 514 is slightly less than the diameter of surface 492. The compression fit is achieved by compressive engagement of an O-ring 516, carried in an outside groove in portion 514, with cylindrical surface 492.

When plug 502 is inserted into the chamber 490, surface 518 engages the proximal end of spring 482 and somewhat compresses the spring 482. When the valve assembly 462 is correctly and fully threaded into member 470, trailing surface 520 of plug 502 contiguously engages shoulder surface 522 of the chamber 490.

Plug 502 comprises a central counterpressure discharge and snift discharge control orifice 524 through which counterpressure discharge and snift discharge, delivered via passageway 468, passes. When plunger 474 is depressed by engagement with either a counterpressure discharge cam or a snift cam, the discharge traverses through orifice 524 and thence through chamber 490 and is discharged to the atmosphere along the interface between the flats 477 of plunger portion 486 and cylindrical bore surface 480. When the plunger 474 is fully extended, O-ring 498 prohibits flow between surfaces 486 and 480. Two spaced cams of the type disclosed in FIGS. 1 through 9 may be used.

O-ring 530, interposed between the threaded region 512 and an exposed flange 532, insures that flow does not occur at the threaded interface between valve assembly 462 and member 470. The polygonal configuration of the exposed region 534 allows use of a wrench or other tool to threadedly place and remove valve assembly 462 into and from member 470, respectively.

The invention may be embodied in other specific forms without departing from the spirit of essential characteristics thereof. The present embodiments are therefore to be considered in all respects as illustrative and are not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A method of modifying an existing nozzle head having a predetermined maximum diametral size in excess of a size accommodating efficaciously filling of a commercial can of reduced top opening size to one which accommodates filling of any of a plurality of commercial cans including said reduced sized cans having variously sized top openings, comprising the acts:

removing from the existing nozzle head only distal beverage discharge structure having said predetermined maximum diametral size which comprise structure defining a radial array of outwardly directed diagonally disposed beverage dispensing flow pathways of a predetermined number and effluent discharge ports while retaining for use a proximal portion of the nozzle head comprising an upstream portion of said predetermined number of flow pathways;

attaching and sealing a different distal adapter comprising a chamber into which all flow through the pathways is discharged and having a radial array of passageways therein the number of which is greater than the predetermined number of pathways, the chamber being superimposed above the pathways and having a maximum diametral size less than the predetermined maximum diametral size to the retained proximal portion of the existing nozzle head to provide a hybrid nozzle head in superposition over the upstream portion so that the flow pathways are not aligned with the passageways.

2. A method of covering a fill valve having a predetermined maximum diametral size in excess of a size accommodating efficaciously filling of a commercial can of reduced top opening size to one which accommodates filling of any of a plurality of commercial cans including said reduced sized cans having variously sized top openings, comprising the acts of:

removing existing distal fill valve structure having said predetermined maximum diametral size thereby removing structure which define a radial array of outwardly directed diagonally disposed beverage dispensing flow pathways comprising a predetermined number and an equal number of effluent discharge ports but preserving a proximal portion thereof which comprises an upstream portion of said array of flow pathways;

attaching and sealing a distal adapter having a maximum diametral size less than the predetermined maximum diametral size contiguous with the upstream portion to create a modified fill valve;

installing the fill valve in automatic beverage dispensing machinery;

causing beverage to flow through the modified fill valve, the flow comprising a stream through each of the predetermined number of flow paths, merging the predetermined number of streams into a single chamber interposed between the preserved proximal portion and the distal adapter, and distributing the flow through the chamber into a plurality of streams through the nozzle adapter.

3. A method according to claim 2 wherein the flow from the chamber is distributed as a circular array of streams flowing downwardly through the nozzle adapter, the number of streams being greater than the predetermined number of flow pathways.

4. A method according to claim 2 wherein the flow through the single chamber passes through a single screen located in the single chamber.

5. A method according to claim 2 wherein the nozzle adapter effluent streams merge distally in an annular cavity at the distal end of the nozzle adapter, beverage being discharged into the can from the annular cavity.

6. A method according to claim 5 wherein annular cavity is directed downwardly and outwardly whereby discharge of merged beverage into the can is against a side wall of the can near a top thereof.

* * * * *